United States Patent [19]

Bolliand

[11] Patent Number: 4,845,902

[45] Date of Patent: Jul. 11, 1989

[54] ROUGH ABRASIVE LIKE MATERIAL

[75] Inventor: Robert Bolliand, Ecully, France

[73] Assignee: Institut Textile de France, Bagneux Cede, France

[21] Appl. No.: 235,778

[22] Filed: Aug. 23, 1988

Related U.S. Application Data

[63] Continuation of Ser. No. 107,875, Oct. 9, 1987, abandoned, which is a continuation of Ser. No. 832,833, Feb. 24, 1986, abandoned.

[30] Foreign Application Priority Data

Feb. 22, 1985 [FR] France ..... 85 02578

[51] Int. Cl.[4] ..... B24D 11/00

[52] U.S. Cl. ..... 51/395; 15/236.01; 264/156

[58] Field of Search ..... 51/204, 211 R, 394, 51/395, 398, 401; 264/155, 156; 15/236 R

[56] References Cited

U.S. PATENT DOCUMENTS 4,028,781 6/1977 Konrad ..... 29/78

FOREIGN PATENT DOCUMENTS 569768 4/1924 France .
1485475 5/1967 France .
568819 11/1975 Switzerland .

*Primary Examiner*—Robert P. Olszewski
*Attorney, Agent, or Firm*—Shenier & O'Connor

[57] ABSTRACT

Rough product constituted of a film of plastic material, such as a mono-drawn polyester film, presenting perforations of which the outlines form craters raised with respect to the surface of the film. This product may be obtained according to the needling technique.

4 Claims, 3 Drawing Sheets

ROUGH ABRASIVE LIKE MATERIAL

This is a continuation of co-pending application Ser. No. 107,875 filed on Oct. 9, 1987 which is a continuation of application Ser. No. 832,833 filed on Feb. 24, 1986 now both abandoned.

FIELD OF THE INVENTION

The invention relates to a new type of rough product, particularly advantageous when applied to the treatment of hard surfaces, such as grinding and polishing of metallic or mineral surfaces, and also to the superficial treatment of textiles.

DESCRIPTION OF THE PRIOR ART

The mechanical abrasion of surfaces, and in particular metallic surfaces, often involves the use of products special for grinding, polishing, sanding or smoothing. The terms "abrasive products" are mentioned hereinafter without any distinction between abrasion, polishing or sanding, knowing that polishing and sanding are included in abrasion, when taken in its broad meaning. The aim in using such products is to obtain an even surface, by removing all superficial irregularities resulting from prior treatments. Therefore, their action is generally a material removing action (finishing to size) and/or a finishing treatment. Products with bonded or coated abrasives are compounds, consisting of a base on which particles of hard materials are fixed by means of a binding agent. With the mechanical treatment, the abrasive support is started, generally in rotation in contact with the surface to be treated, and it is the particles fixed on the base, which by friction remove the material. The material constituting the abrasive particles and the size of said particles are selected as a function of the nature of surface to be treated and of the required finish. One of the disadvantages of such abrasive products is their early wear which is due to overheating and to the abrasive particles coming off during the treatment.

There is a second grinding and polishing technique, known as the free abrasive technique, in which polishing agents in liquid form are added on a base. Said polishing agents are essentially mixtures of fats, oils and alcohols which have a lubricant and cooling effect, in which mixtures are dispersed carefully calibrated particles of different abrasives such as diamond, alumina, carbide or metallic oxides, etc. Said agents are normally introduced in continuous manner, dropwise, throughout the treatment seeing that the movement of the abrasive base, such as, for example, its high speed rotation, moves the polishing agent out of the treatment zone proper, under the action of the centrifugal force. It is therefore imperative to keep renewing the polishing agent. And this is another disadvantage of these methods. The same applies to the diamond-charged paste, as this requires a constant supply of a diluting agent throughout the treatment, which diluting agent is centrifuged with the abrasive.

SUMMARY OF THE INVENTION

A new product has now been found, and this precisely the object of the invention, which overcomes all the aforesaid disadvantages. Said product, which, according to the invention isused as an abrasive base, is composed of a thin supple film of perforated plastic, the outline of the perforations forming raised craters on the surface of the film. The product according to the invention is used as a base for a polishing agent: there can no longer be a driving movement as on a smooth surface, or any coming off of the particles as in the conventional methods. What happens is only a wearing down of the raised parts; but it has been unexpectedly discovered that the wearing down of the edges of the perforations made in the plastic film is a very slow process, compared for example with the wear resulting from the coming off of the particles on a bonded abrasive.

In preferred manner, the plastic film used will have the adequate mechanical strength characteristics, such as for example polyester, polyamide, polyimide or polypropylene films. By thin film is meant a film whose thickness is generally included within a range going from ten to several hundreds μm. Thicknesses of 23, 36, 50, 75, 100, 125 and 175 μm are particularly suitable.

Advantageously, the perforations are produced with needles, according to a technique similar to that used in the textile industry and called needling. In this bonding technique, used in the production of non-wovens, the fibers are intermingled by the action of a large number of needles going through a layer of fibers according to a reciprocating movement. The layer, moved by a conveyor, passes through the plates of the needling machine. The strength of the non-woven increases with the density of the needling stitches. Thus, according to the same technique, it is possible to make in a plastic film, perforations of given shape and dimension, said perforations being dependent on the type of needles used, and in a given density, depending on the population of needles and on the number of strokes performed in the needling operation. When examining a perforation under the microscope, it is seen that the plastic material is pushed in at the place of impact of the needle, forming a sort of crater of which the edges are dependent on the configuration of the cross-section of the needle, this cross-section being preferably triangular. It is the edges of the craters, applied against the surface to be treated, in combination with the abrasive particles, which are the active elements. The quantity of plastic material constituting the edges of a crater and the size of this crater are dependent on the cross-section of the needle and generally on the depth at which the needle penetrates into the film. The greater the cross-section of the needle and/or the depth of penetration of the needle, the greater the size of the perforations will be. It is therefore possible to vary with relative accuracy the dimensions of these perforations by appropriate adjustment of the needling installation. Moreover, the number of perforations is conditioned, on the one hand, by the density of needle implantation on the needle plate, which is generally between 1800 and 15000 needles per metre length, and, on the film while this film is moving (number of strokes/minute), and lastly by the film moving speed.

When a polishing agent is added, it is unexpectedly found that, contrary to what happens with the conventional abrasive products, there is no discharge of the polishing agent during the displacement of the product according to the invention, therefore it is no longer necessary to supply said agent as often and in such large quantity. This phenomenon might be explained by examining the behavior of the perforations through the displacement of the abrasive product during the polishing treatment. Taking for example a rough film cut into a circular ring shape which is fixed on a rotatable base. During the polishing operation, the base, and as a result the abrasive product, rotate at high speed. The piece, of which the surface is to be polished, is applied against the rough surface of the film, while the polishing agent is poured dropwise on the rough film. We know that with the conventional abrasive products, the polishing agent is pushed by the centrifugal force outwardly from the disk. With the product according to the invention, the perforations will create as many obstacles and will act as suction cups to hold back the polishing agent: said perforations are pressed in and they deform when applied against the piece to be treated, then they resume their initial shape. In that movement, they release and somehow suck in the liquid agent which is close by, then causing a continuous movement of mixing and self-cleaning of the abrasive particles.

Although for treating hard surfaces, the abrasive products according to the invention are used preferably in combination with an abrasive, it has been found that they are particularly advantageous, used on their own, for treating textile surfaces, and in particular for napping suede materials, or drawing out the hairs in order to increase the bulk of a fabric.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
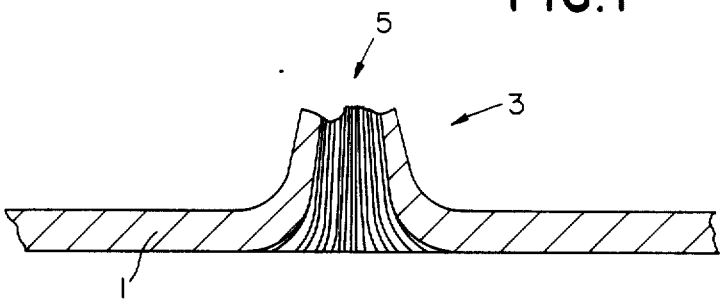
FIG. 1 is a diagrammatical view in cross-section of a film according to the invention taken at the level of the perforation.
Figure 2:
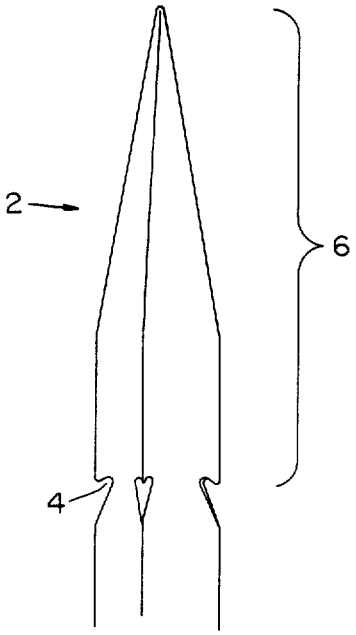
FIG. 2 is a partial view of a needle used in the manufacturing process according to the invention.
Figure 3:
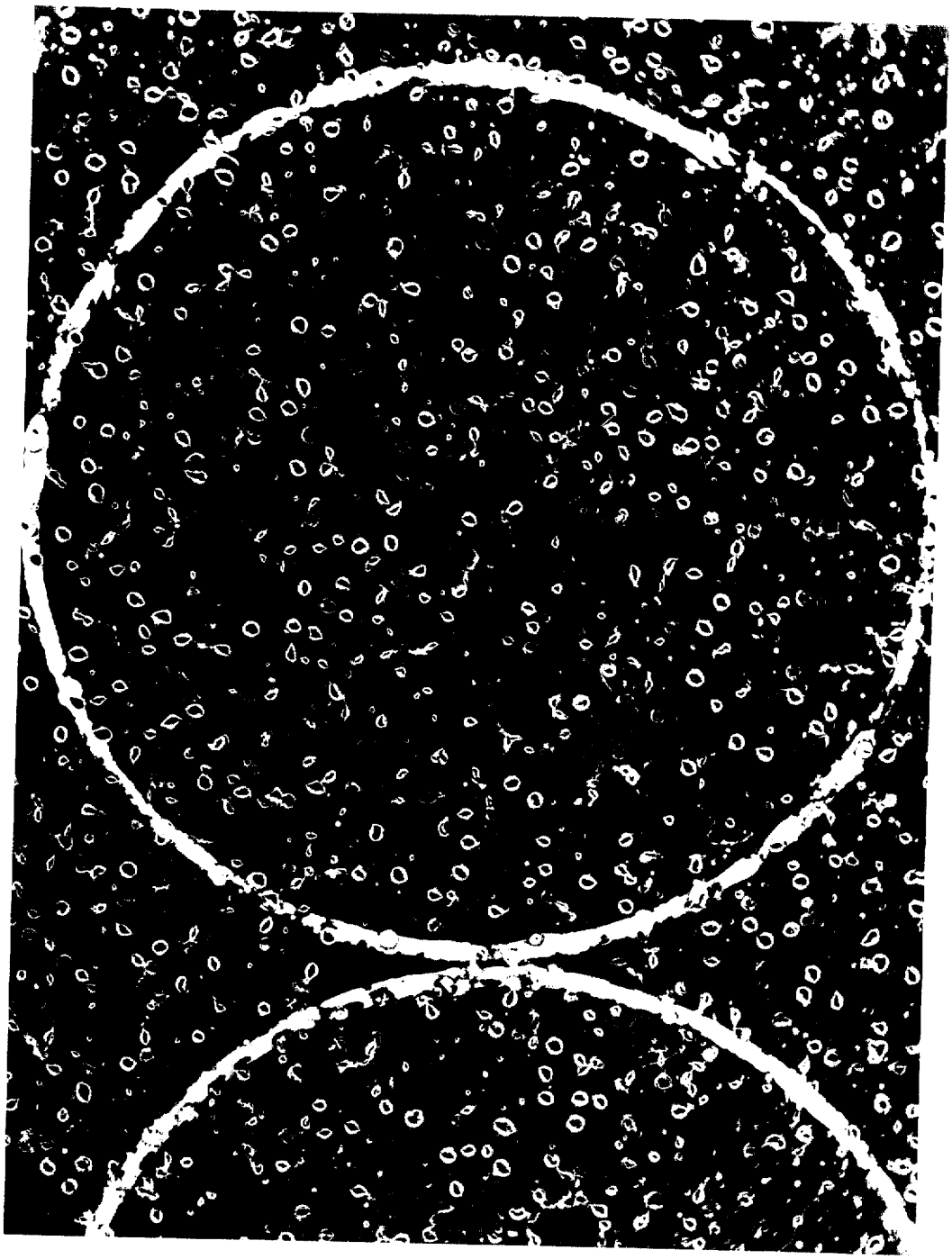
FIG. 3 is a photographic reproduction taken under a microscope (magnification × 14) of a perforated film.

As illustrated in FIGS. 1 and 3, the film 1 is a monodrawn polyester film - sold under the trademark TERPHANE®—of 6/100th millimeter thickness, and weighing 70 g per square meter. Said film goes through a textile-type needling machine composed of a needle plate moving according to an up and down reciprocating movement, two perforated plates, a supply conveyor for transporting the film, and two output cylinders, synchronous with the movement of the needle plate, so that the film does not move while the needle plate is lowered, and it moves forward over a certain distance, while the plate is raised, namely when the film is no longer traversed by the needles. The film is inserted between the two plates which hold it in position while the needles are operating. The needle plate goes down until the needles come into contact with the film and go through it. The equipment comprises a mechanism for adjusting the striking stroke, namely the displacement of the needles, which stroke is generally between 50 and 75 millimeters. In the bonding of textile webs, such adjustment makes it possible to vary the depth of penetration of the needle into the web. In the present case where a plastic film is perforated in order to obtain the abrasive product according to the invention, the striking stroke is adjusted in such a way that the penetration of the needle into the film is very short, between one and a few millimeters. Whatever the case, only the smooth part 6 of the needle 2 must penetrate into the film (see FIG. 2) so that the material which is pushed in by the needle 2 on impact, stays on the same side of the film and forms a crater 3. Indeed, with a normal adjustment, the part of the needle which is provided with the burrs 4 for catching the fibers of the textile layer, would penetrate into the film and, when raised out, would carry part of the material through to the other face of the film. For example, as illustrated in FIG. 1, when the needle 2 penetrates into the film 1, the material of film 1 is torn and pushed outwardly by the needle 2, forming a crater 3 with more or less regular walls. As clearly shown in FIG. 1, the crater-like walls have jagged edges of reduced thickness. The photograph shown in FIG. 3 gives a clear view of all the craters formed by the impact of the needles, with relatively homogeneous dimensions which depend on the fineness of the adjustment of the needling equipment. In the example illustrated in FIG. 3, there has been 150 needle strokes per square centimetre with a striking stroke adjusted to 1 mm. The needles used were SINGER® type 15×18×36×3.5 BL.

The perforated film was then tested on a MECAPOL® type polishing machine, rotating at 300 revs per minute, six samples of metal of diameter 30 mm being applied on the diskshaped film with a pressure of 7 kg. The polishing agent used was a diamond-charged spary of 9.66 μm. An average removal of metal of 9.66 g per sample was noted after 4 minutes of the test, of 8.66 g after a second 4-minute operation and of 8.16 g after a third 4-minute operation.

It was also found that the polishing agent had preferably deposited, after passage of the film under the metal samples, in the cavities constituted by the perforations. The polishing waste, on the contrary, had collected preferably on the free surface between the craters, this permitting its elimination by washing.

To obtain good results with the product according to the invention, the craters must be able to react under the pressure of the material to be treated and to behave as so many micro-pumps moving the polishing agent. To illustrate this necessity, the film was fixed on the rotating base of the test equipment, with an adhesive which was left to rise inside the craters of the film: the craters, being blocked up by the adhesive, no longer act as a pump and a reservoir of polishing agent, and the film then loses a big part of its abrasive properties.

Figure 4:
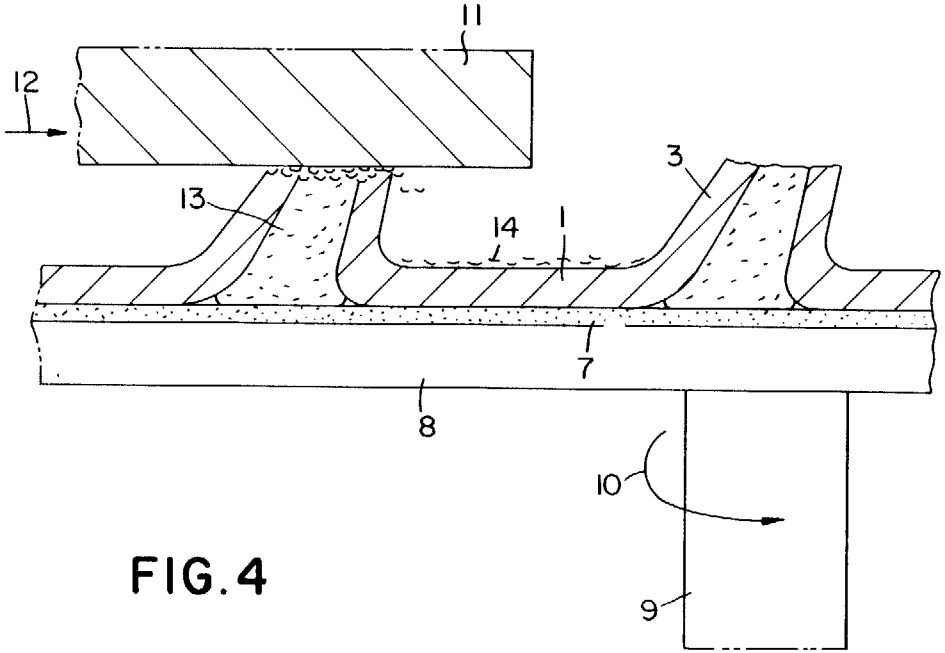
FIG. 4 is a diagrammatical view in cross-section of the film shown in FIG. 1; when used as an abrasive base.

This utilization of the abrasive support according to the invention is illustrated in FIG. 4 which shows the film 1 bonded with an adhesive 7 on a disk 8 mounted for rotating on a shaft 9 driven in the direction of arrow 10.

The piece to be treated 11 is supported and driven in the direction of arrow 12. The craters 3 contain the abrasive particles and the polishing agent 13 and the wastes, released on the surface of the piece being treated 22, collect in the empty spaces 14 between the craters.

When applied to the mechanical finish of textile materials, the rough film according to the invention has also proved very advantageous. One typical example of polyester film used has the following characteristics: thickness: 23 μm, density: 1.39 g/m3; breaking strength: 19 daN/mm2 lengthwise and widthwise; elongation to break point: 120% lengthwise and 80% widthwise; modulus of elasticity at 0.5% elongation: 450 daN/mm2 lengthwise and width-wise. During the tests, it was found that the desirable perforation density was 20 to 150 perforations pe cm2, and preferably 40 to 50 perforations, the distribution of the perforations being random-type in order to avoid any possibility of interference on the pieces to be treated.

Napping tests were conducted on fabrics in order to determine, on the one hand, the behavior of the perforated film, and on the other hand, and depending on the type of textile fabric subjected to this napping test, what modifications have been made to the appearance.

It was found, from these tests, that, comparatively to a very fine abrasive (for example fine sandpaper), such as generally used in textiles control laboratories to simulate the destructive abrasion of a fabric, the perforated film is by far the least active. For example for a cotton taffeta fabric of 60 warp yarns per cm and 28 weft strokes per cm, with a weight/m2 of 120 g, it was found that with a film perforated at 45 holes/cm2, after 900 runs and under a pressure of 250 g, abrasion was very regular and there was no perforation.

On the contrary, after 10 runs with a sandpaper (Ref.P.1200), and under a pressure of 250 g, already three perforations were found.

Degradation is therefore slower with the perforated film.

Observing periods are therefore longer, permitting, for control tests, a more accurate supervision.

The perforated film shows a slower aggression compared with the finest abrasive now on the markets, and offers good finishing possibilities for delicate suede-type materials.

Another series of tests was conducted to study the use of the perforated film for increasing the bulk of a fabric.

Scarves materials are of twill or satin types, thus presenting on one face very large floats of fibers. The use of the rough film according to the invention with these fabrics has given very good results from the point of view of drawing the hairs on such fabrics. For example, for a scarf material (100% acrylic, 250 g/m2, 8 warp yarns per cm, 12 weft strokes, it was found that the mean length of strands drawn was 20 mm. Moreover, the bulk was considerable and the loss of strands through break was very low.

What is claimed is:

1. An abrasive-like material constituted of a thin abrasive-free film of flexible plastic material having a thickness of less than 175 micrometers and a generally flat surface, said film having a plurality of perforations therein, said perforations being surrounded by supple and non-cutting crater-like walls protruding above said surface, said walls having jagged edges of reduced thickness, said walls being formed by displaced film portions and caused solely by the action of reciprocating needles driven through and withdrawn from said film.

2. A rough product as claimed in claim 1, wherein said film is made from polyester, polyamide, polyimide or polyprophylene.

3. A rough product as claimed in claim 2, wherein said film is a mono-drawn polyester film.

4. A rough product as claimed in claim 1, wherein said film has an average of 20 to 150 perforations per $cm^2$, and preferably 40 to 50 per $cm^2$.

* * * * *